US012628904B2

(12) United States Patent
Meredith

(10) Patent No.: US 12,628,904 B2
(45) Date of Patent: May 19, 2026

(54) ORTHOTIC POSITIONING APPARATUS AND SYSTEM

(71) Applicant: Grippr, LLC, New York, NY (US)

(72) Inventor: Brent Meredith, New York, NY (US)

( * ) Notice: Subject to any disclaimer, the term of this patent is extended or adjusted under 35 U.S.C. 154(b) by 0 days.

(21) Appl. No.: 18/385,453

(22) Filed: Oct. 31, 2023

(65) Prior Publication Data

US 2025/0134203 A1 May 1, 2025

(51) Int. Cl.
*A43B 7/26* (2006.01)
*A43B 17/00* (2006.01)

(52) U.S. Cl.
CPC ..... *A43B 7/26* (2013.01); *A43B 17/00* (2013.01)

(58) Field of Classification Search
CPC ..... A43B 7/26; A61F 5/019
USPC ..... 36/94, 36, 11.5
See application file for complete search history.

(56) References Cited

U.S. PATENT DOCUMENTS

| | | | | |
|---|---|---|---|---|
| 963,605 | A | 7/1910 | Mannesmann | |
| 1,402,375 | A | 1/1922 | Parisi | |
| 2,444,640 | A | 7/1948 | Epstein | |
| 2,506,308 | A | 5/1950 | Maynier | |
| 2,531,851 | A | 11/1950 | Kiwad | |
| 2,542,319 | A | 2/1951 | Ferri | |
| 3,429,309 | A | 2/1969 | Kurth et al. | |
| 4,207,880 | A * | 6/1980 | Zinkovich | A43B 7/26 36/94 |
| 5,438,768 | A | 8/1995 | Bauerfeind | |
| 5,768,803 | A | 6/1998 | Levy | |
| D409,824 | S | 5/1999 | Byrd | |

(Continued)

FOREIGN PATENT DOCUMENTS

| | | |
|---|---|---|
| JP | 01218446 | 2/1988 |
| JP | 2005305063 | 4/2004 |

(Continued)

OTHER PUBLICATIONS

Pnrskter Foot Care Products; Ball of Foot Cushions, (4PCS) Metatarsal Pads, Toe Separator, Toe Spacers, Breathable & Soft Gel Foot Pads, Forefoot Pads for Mortons Neuroma Callus, Diabetic Fee, Blisters; Amazon listing; Oct. 31, 2023; Eleven Pages; https://www.amazon.com/gp/product/B07KQZ8MNS/ref=ppx_yo_dt_b_search_asin_title?ie=UTF8&th=1.

(Continued)

*Primary Examiner* — Alissa L Hoey
*Assistant Examiner* — Akwokwo Olabisi Redhead
(74) *Attorney, Agent, or Firm* — Goldstein Law Offices, P.C.

(57) ABSTRACT

An orthotic positioning apparatus includes a shoe having an interior and an exterior upper. The exterior upper includes a perimeter edge defining an elongate opening extending between a toe box and a foot opening. An insole is removably disposed within the interior and includes a toe area having multiple resilient toe separator elements projecting upwardly from a top surface of the insole along an arc. When the insole is disposed in the interior of the shoe, the resilient toe separator elements are positioned in the toe box and configured to separate adjacent toes of a user. A top edge of a cover is pivotally coupled to the toe box and configured to cover the elongate opening. The cover selectively pivots upwardly such that the elongate opening exposes the resilient toe separator elements.

18 Claims, 14 Drawing Sheets

(56) References Cited

U.S. PATENT DOCUMENTS

| | | | | |
|---|---|---|---|---|
| 5,946,823 | A | 9/1999 | Yates | |
| D420,785 | S | 2/2000 | Perez | |
| 6,116,253 | A | 9/2000 | Armstrong | |
| D439,704 | S | 3/2001 | Ikeda | |
| 6,874,256 | B2 | 4/2005 | Delgatty | |
| 7,134,225 | B2 | 11/2006 | Ashton | |
| D591,487 | S | 5/2009 | Hayek | |
| 7,603,797 | B2 | 10/2009 | Chung | |
| 7,681,332 | B2 | 3/2010 | Allen | |
| 7,784,115 | B1 | 8/2010 | Nemcik | |
| D632,013 | S | 2/2011 | Irwir | |
| 8,117,768 | B2 | 2/2012 | Bobbett | |
| D661,429 | S | 6/2012 | Huthmaker | |
| D696,819 | S | 12/2013 | Huthmaker | |
| 9,072,338 | B1 | 7/2015 | Kostecky | |
| D742,103 | S | 11/2015 | Slipak | |
| 10,638,814 | B2 | 5/2020 | Mancini et al. | |
| 11,246,731 | B2 | 2/2022 | Ferri | |
| 11,324,279 | B2 | 5/2022 | Spencer | |
| D962,453 | S | 8/2022 | He | |
| 11,412,815 | B1 | 8/2022 | Sereg-Mangano | |
| 12,004,597 | B2 | 6/2024 | Liu | |
| 2003/0145492 | A1 | 8/2003 | Brooks | |
| 2005/0229430 | A1 | 10/2005 | Takaba | |
| 2006/0064902 | A1 | 3/2006 | Ashton | |
| 2007/0011915 | A1* | 1/2007 | Allen | A43B 1/0081 36/94 |
| 2008/0086918 | A1 | 4/2008 | Chung | |
| 2008/0216353 | A1* | 9/2008 | Langvin | A43B 13/187 36/44 |
| 2009/0217551 | A1* | 9/2009 | Shirokikh | A43B 13/146 36/102 |
| 2009/0217552 | A1* | 9/2009 | Paintin | A43B 11/00 36/138 |
| 2010/0263237 | A1* | 10/2010 | Cuellar | A43B 3/24 132/73 |
| 2011/0283563 | A1* | 11/2011 | Ferri | A61F 5/019 482/79 |
| 2013/0269213 | A1* | 10/2013 | Gift | A43B 7/26 36/136 |
| 2015/0374094 | A1 | 12/2015 | Gift | |
| 2018/0199670 | A1 | 7/2018 | Craven | |
| 2019/0029389 | A1 | 1/2019 | Levy et al. | |
| 2019/0082776 | A1 | 3/2019 | Cloutier | |
| 2019/0289957 | A1* | 9/2019 | Lee | A43B 7/26 |
| 2021/0361462 | A1 | 11/2021 | Liu | |

FOREIGN PATENT DOCUMENTS

| | | | |
|---|---|---|---|
| JP | 2016193160 | A | 11/2016 |
| WO | WO2016133414 | | 2/2016 |
| WO | 2016133414 | A1 | 8/2016 |
| WO | WO2018159903 | | 7/2017 |
| WO | WO2019093578 | | 12/2017 |
| WO | WO2019164357 | | 2/2019 |

OTHER PUBLICATIONS

Zen Toes; Silicone Toe Spacers for Correct Toe Alignment, Bunion and Hammertoe Straighteners—2 Pairs; Amazon listing; Oct. 31, 2023; Ten Pages; https://www.amazon.com/gp/product/B09FFTZ7NB/ref=ppx_yo_dt_b_search_asin_title?ie=UTF8&psc=1.

Yogabody Naturals; Toe Spreaders & Separators, Fast Pain Relief from Hammertoe & Bunions, Two Pairs in Stylish Wooden Box, Latex-Free Rubber Toe Stretchers Used for Walking, Running & Yoga Practice; Amazon listing; Oct. 31, 2023; Eleven Pages; https://www.amazon.com/dp/B01AUZWM64?ref=nb_sb_ss_w_as-reorder-c1_k1_1_9&amp-&crid=3LKFCMGRWYQJU&amp=&sprefix=yoga+toes.

Written Opinion and International Search Report of the International Searching Authority for PCT/US2023/083370 established by the ISA/US completed on Apr. 5, 2024.

International Preliminary Report on Patentability of the International Preliminary Examining Authority for PCT/US2023/083370 established by the IPEA/US completed on Mar. 11, 2025.

* cited by examiner

ORTHOTIC POSITIONING APPARATUS AND SYSTEM

TECHNICAL FIELD

The present disclosure relates generally to orthotic devices. More particularly, the present disclosure relates to orthotic footwear and insoles.

BACKGROUND

Foot and toe deformities, such as hallux valgus (commonly known as bunions), hammertoe, and/or overlapping toes, are frequently encountered problems caused by wearing poorly fitting shoes. These conditions can lead to significant discomfort, pain, limitations in mobility, and permanent disfigurations that cause uneven distribution of strain on muscles and tendons that may affect the entire leg and hip. Individuals suffering from such deformities often resort to corrective devices, specialized footwear, or even surgical interventions to address these issues.

Conventional solutions for toe deformities typically involve the use of external toe separators or spacers. These are typically separate accessories or devices that are placed between the toes to encourage proper alignment. While these external devices can offer relief, they often come with notable drawbacks. External toe separators can be cumbersome and inconvenient to use daily, especially within regular shoes. Additionally, some individuals find these external accessories uncomfortable to wear for extended periods, as they may cause pressure points, friction, or irritation between the toes. Some users may also feel self-conscious about wearing devices that are visible when worn with open-toe shoes. Since the effectiveness of external separators varies depending on the user's willingness and adherence to wearing them consistently, these drawbacks may render such devices ineffective.

What is needed is a discreet orthotic positioning apparatus that integrates an insole with built-in toe separators, thereby eliminating the need for external accessories. Additionally, what is needed is an orthotic positioning apparatus that maintains proper toe alignment, effectively preventing the progression of foot deformities. Beneficially, the orthotic positioning apparatus would enable easy access to the shoe's interior while providing a clear view of the toe separators to enhance convenience. Finally, what is needed is an orthotic positioning apparatus that facilitates progressively increasing the spacing between toe separators to accommodate users' evolving needs and comfort levels.

BRIEF SUMMARY

According to one aspect of the present disclosure, an orthotic positioning apparatus includes a shoe extending along a longitudinal axis. The shoe includes an interior, an exterior upper, a foot opening, and a toe box. The exterior upper includes a perimeter edge defining an elongate opening extending between the toe box and the foot opening. An insole is removably disposed within the interior and includes a top surface, a bottom surface, a toe area to receive a user's toes, and multiple resilient toe separator elements projecting from the top surface along an arc. When the insole is disposed within the interior of the shoe, the resilient toe separator elements are positioned within the toe box. Each of the resilient toe separator elements has a width configured to separate adjacent ones of the user's toes by a predetermined distance.

A cover is configured to cover the elongate opening. The cover includes a top edge pivotally coupled to the toe box, and a bottom edge. The cover is configured to selectively pivot upwardly in an open configuration such that the elongate opening exposes the resilient toe separator elements in the open configuration.

In some embodiments, the perimeter edge includes a pair of lateral edges disposed parallel to the longitudinal axis and separated by a distance substantially corresponding to a width of the toe area. The orthotic positioning apparatus may further include one or more stabilization elements extending substantially perpendicularly between the pair of lateral edges. In some embodiments, the stabilization element obstructs at least a portion of the elongate opening. The stabilization element may be adjustable and/or removable.

In some embodiments, the shoe and/or the insole includes a heel configured to provide zero-drop. In some embodiments, the cover includes an attachment portion disposed adjacent to the bottom edge. In certain embodiments, the exterior upper includes an engagement element configured to selectively engage the attachment portion.

In some embodiments, the insole includes a predetermined space between adjacent resilient toe separator elements such that the predetermined space is configured to accommodate one of the user's toes. In certain embodiments, the predetermined space is between about 1.0 cm and about 1.8 cm. In some embodiments, each of the resilient toe separator elements includes an oblong shape extending along an axis parallel to the longitudinal axis. In certain embodiments, each of the plurality of resilient toe separator elements includes a height greater than or equal to the predetermined space. In some embodiments, the height ranges between about 1.0 cm and about 2.2 cm. In some embodiments, the width of each of the plurality of resilient toe separator elements is less than the predetermined space.

In some embodiments, each of the resilient toe separator elements extends through the insole between the bottom surface and the top surface. In some embodiments, the insole further includes a connector strip coupled to the resilient toe separator elements. The connector strip may be substantially planar and each of the plurality of resilient toe separator elements may project upwardly from the connector strip. In certain embodiments, the connector is substantially rigid such that the connector strip provides support and stability to the plurality of resilient toe separator elements. In some embodiments, the bottom surface of the insole comprises a recess configured to accommodate the connector strip.

According to another aspect of the present disclosure, an orthotic positioning system includes a shoe, a first stage insole, a second stage insole, and a cover. The shoe extends along a longitudinal axis and includes an interior, an exterior upper, a foot opening, and a toe box. The exterior upper includes a perimeter edge defining an elongate opening extending between the toe box and the foot opening.

The first stage insole is removably disposed within the interior and includes a first top surface, a first bottom surface, a first toe area configured to receive a user's toes, and first resilient toe separator elements projecting upwardly from the first top surface along a first arc. When the first stage insole is disposed within the interior of the shoe, the first resilient toe separator elements are positioned within the toe box. Each of the first resilient toe separator elements includes a first width configured to separate adjacent ones of the user's toes by a first predetermined distance.

The second stage insole is configured to selectively replace the first stage insole. The second stage insole includes a second top surface, a second bottom surface, a second toe area configured to receive the user's toes, and second resilient toe separator elements projecting upwardly from the second top surface along a second arc. When the second stage insole is disposed within the interior of the shoe, the second resilient toe separator elements are positioned within the toe box. Each of the second resilient toe separator elements includes a second width configured to separate adjacent ones of the user's toes by a second predetermined distance. The second predetermined distance is greater than the first predetermined distance.

The cover is configured to selectively cover the elongate opening and includes a top edge pivotally coupled to the toe box, a bottom edge, and a pair of side edges extending between the top edge and the bottom edge. The cover is configured to selectively pivot upwardly to an open configuration such that the elongate opening exposes the first plurality of resilient toe separator elements or the second resilient toe separator elements in the open configuration.

In some embodiments, the first stage insole and the second stage insole each include a connector strip coupled to the first resilient toe separator elements and the second resilient toe separator elements, respectively. The connector strip may be substantially planar. The first resilient toe separator elements and the second resilient toe separator elements, respectively, may project upwardly from the connector strip such that the connector strip provides support and stability to the first resilient toe separator elements and the second resilient toe separator elements, respectively.

BRIEF DESCRIPTION OF THE DRAWINGS

In the drawings, like elements are depicted by like reference numerals. The drawings are briefly described as follows.

Figure 1:
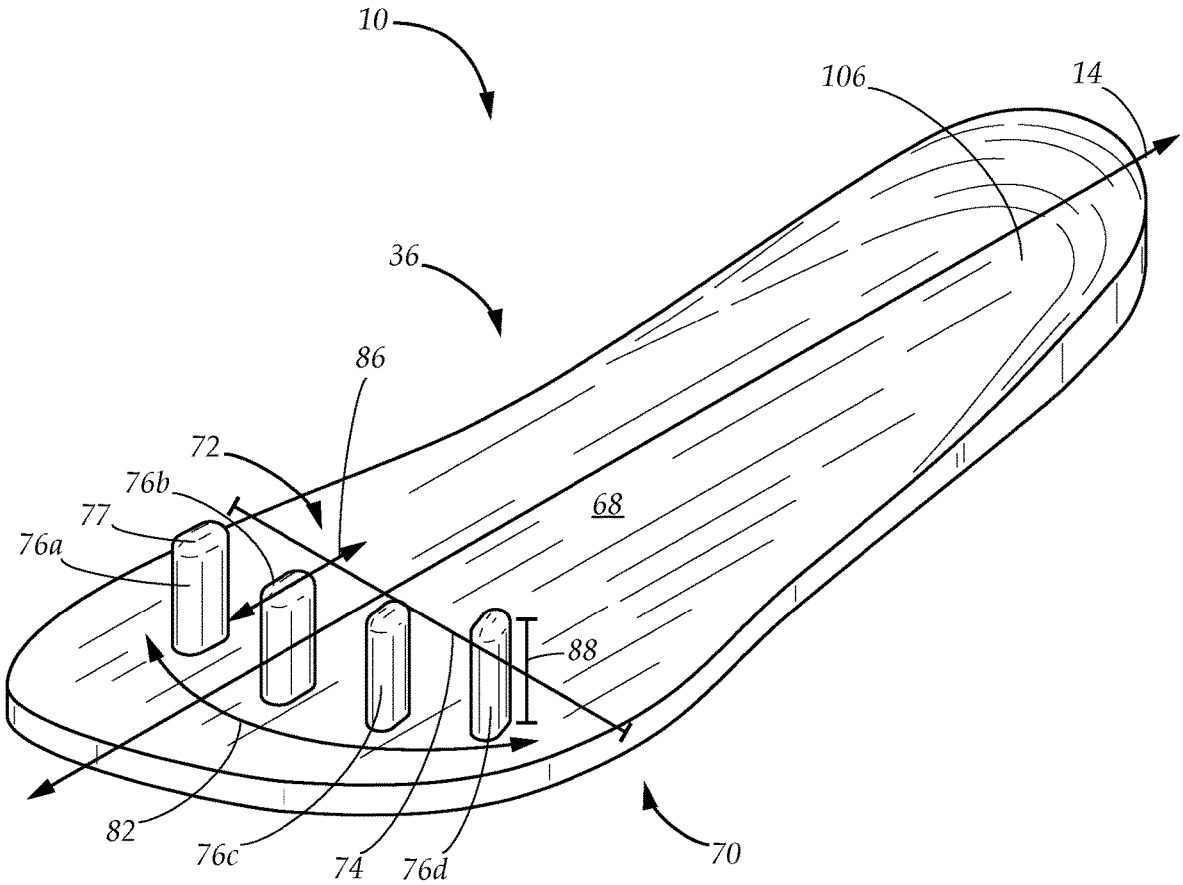
FIG. 1 is a perspective view of one embodiment of an insole having multiple resilient toe separator elements in accordance with some embodiments of the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, foot and toe deformities are frequently caused by wearing poorly fitting shoes. These conditions can lead to significant discomfort and permanent disfigurations that cause uneven distribution of strain on muscles and tendons that may affect the entire leg and hip. Currently available devices to treat such deformities tend to be cumbersome, inconvenient, and uncomfortable. Users may thus be unwilling to use such devices consistently, rendering them largely ineffective. The present disclosure addresses these and other issues.

As used herein, the term "toes" refers to the metatarsals and/or phalanges of a user's foot. The term "insole" refers to a removable inner sole of a shoe.

Referring now to FIGS. 1, 2, 6A and 6C, in some embodiments, an orthotic positioning apparatus 10 includes a shoe 12 having an interior 16 configured to house an insole 36. In some embodiments, the shoe 12 includes an athletic shoe, a boot, a sandal, a dress shoe, and/or any other suitable shoe.

The insole 36 may be configured to position the toes 32 of a user within the interior 16 of the shoe 12 as needed to relieve and/or treat common foot and toe deformities, such as hallux valgus or overlapping toes. The shoe insole 36 may include a resilient cushion material including, for example, latex foam rubber, silicone, and/or a polymer material such as polyurethane ("PU") or ethylene-vinyl acetate copolymer ("EVA"). In some embodiments, the insole 36 may include any combination of ridges, recesses, grooves, bumps, and/or any other suitable textures or features to improve user comfort, fit, breathability, aesthetics, or the like.

In some embodiments, the insole 36 includes a top surface 68, a bottom surface 70, and a toe area 72 to receive the user's toes 32. Multiple resilient toe separator elements 76*a*-76*d* may project from the top surface 68 of the insole 36. Each of the resilient toe separator elements 76*a*-76*d* may be separated from each other of the resilient toe separator elements 76*a*-76*d* in an arc 82 or staggered configuration. Each of the resilient toe separator element 76*a*-76*d* may be configured to be disposed between adjacent toes 32 of the user. In some embodiments, each of the resilient toe separator elements 76*a*-76*d* includes a dome-shape having a height 88 between the top surface 68 of the insole 36 and an upper surface 77 of the resilient toe separator element 76*a*-76*d*. In some embodiments, the height 88 may be in a range between about 1.0 cm and about 2.6 cm.

In some embodiments, the top surface 77 of one or more of the resilient toe separator elements 76*a*-76*d* includes an oval or other suitable oblong shape. In certain embodiments, the shape of the resilient toe separator elements 76*a*-76*d* may include curved edges to promote user comfort between adjacent toes 32. In some embodiments, one or more of the resilient toe separator elements 76*a*-76*d* extends along an axis 86 substantially parallel to the longitudinal axis 14.

In some embodiments, the resilient toe separator elements 76*a*-76*d* are monolithically formed as a single unit. In other embodiments, each of the resilient toe separator elements 76*a*-76*d* is individually molded. In some embodiments, the multiple resilient toe separator elements 76*a*-76*d* are integrated with the insole 36 such that the multiple resilient toe separator elements 76*a*-76*d* and the insole 36 are monolithically formed as a single unit. In other embodiments, the multiple resilient toe separator elements 76*a*-76*d* are coupled to the toe area 72 of the insole 36 individually or as a unit such that the each of the multiple resilient toe separator elements 76*a*-76*d* projects from the top surface 68.

The toe area 72 may span a width 74 sufficient to enable the multiple resilient toe separator elements 76*a*-76*d* to position a user's toes 32 where they should naturally fall with respect to the top surface 68. In some embodiments, the width 74 may range between about 5 cm and about 13 cm. In some embodiments, the multiple resilient toe separator elements 76*a*-76*d* are oriented along an arc 82 such that each of the multiple resilient toe separator elements 76*a*-76*d* substantially aligns with a desired orientation of a space between adjacent ones of the user's toes 32.

In some embodiments, each of the resilient toe separator elements 76*a*-76*d* includes a width 78 configured to separate adjacent ones of the user's toes 32 by a predetermined distance 80, thereby positioning the user's toes 32 where they should naturally fall. For example, in some embodiments, the width 78 may range between about 7 mm and about 20 mm to achieve a predetermined distance 80 of approximately an equivalent distance between adjacent ones of the user's toes 32. In this manner, the multiple resilient toe separator elements 76*a*-76*d* may thereby relieve and/or treat a foot or toe malady such as hallux valgus and/or overlapping toes resulting from long-term wearing of improperly-fitting shoes.

In some embodiments, the insole 36 includes a predetermined space 84 between adjacent resilient toe separator elements 76*a*, 76*b* such that the predetermined space 84 is configured to accommodate a specific one of the user's toes 32. For example, in certain embodiments, the predetermined space 84 is between about 1.0 cm and about 1.8 cm. In some embodiments, the predetermined space 84 may be greater than the width 78 of a resilient toe separator element 76*a*-76*d*. In these and other embodiments, the predetermined space 84 may be less than or equal to the height 88 of a resilient toe separator element 76*a*-76*d*.

In some embodiments, the bottom surface 70 of the insole 36 may be completely flat such that the heel 106 provides zero-drop, or no height difference, between the toe area 72 and the heel 106. In other words, the top surface 68 of the heel 106 of the insole 36 may have the same elevation as the top surface 68 of the toe area 72 of the insole 36, thereby facilitating alignment of the user's spine and a natural heel strike.

Figure 3A:
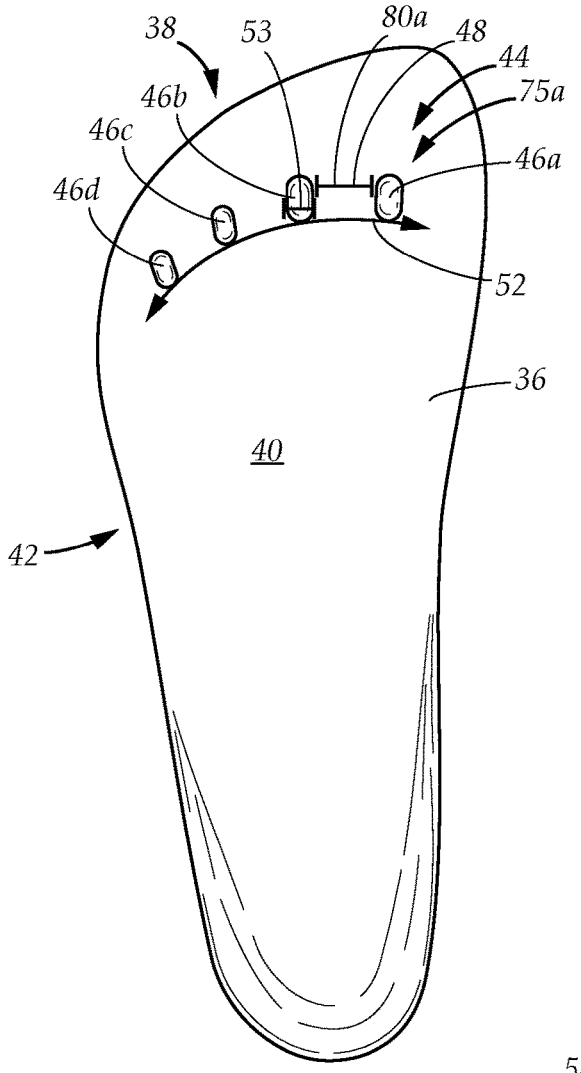
FIG. 3A is a top perspective view of one embodiment of a first stage insole of an orthotic positioning system in accordance with some embodiments of the present disclosure.
Figure 3B:
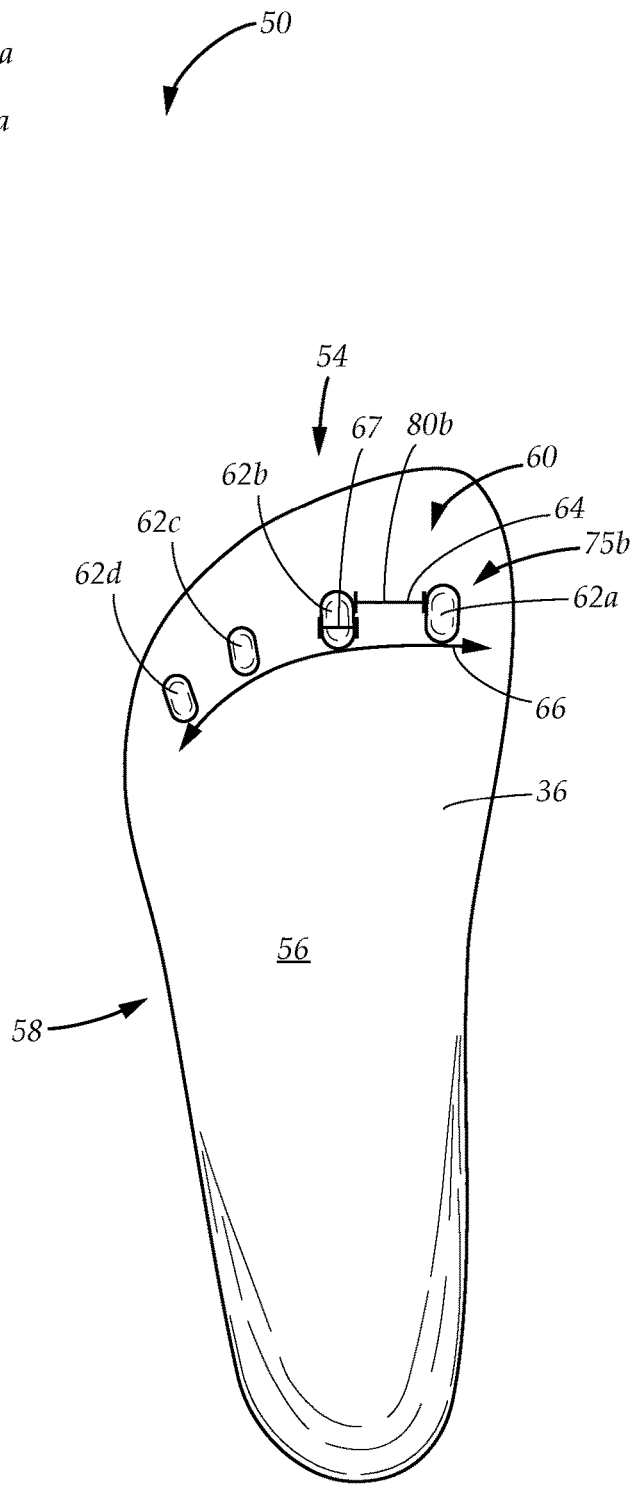
FIG. 3B is a top perspective view of one embodiment of a second stage insole of an orthotic positioning system in accordance with some embodiments of the present invention.
Figure 6A:
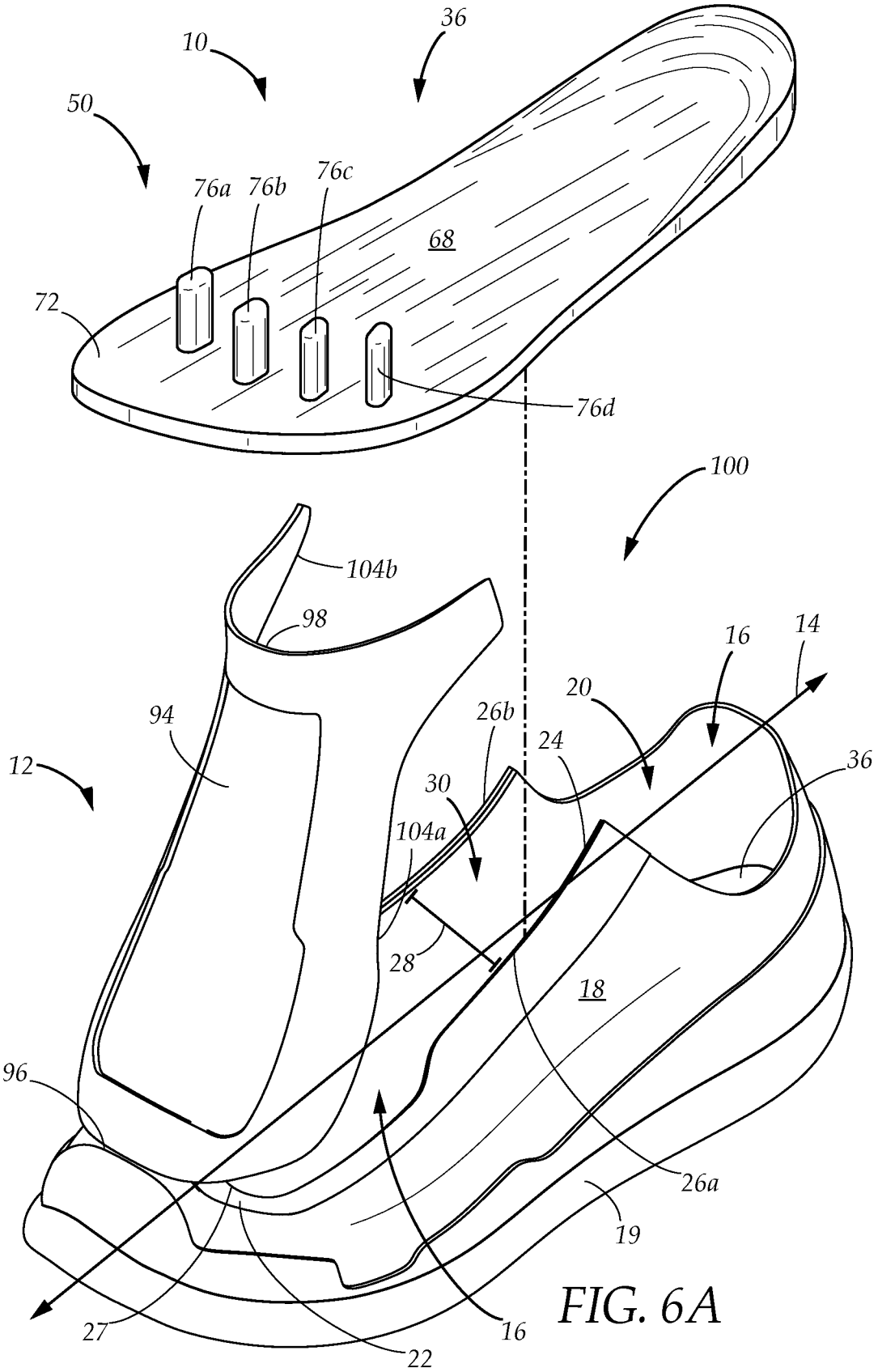
FIG. 6A is an exploded perspective view of one embodiment of an orthotic positioning system that includes an insole disposed within a shoe incorporating a cover configured to open upwardly from a top edge to expose multiple toe separator elements in accordance with the present disclosure.
Figure 11A:
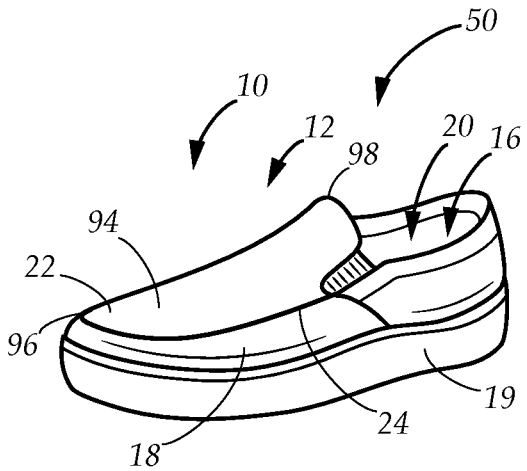
FIG. 11A is a side perspective view of one embodiment of a representative sneaker in accordance with some embodiments of the present disclosure.
Figure 11B:
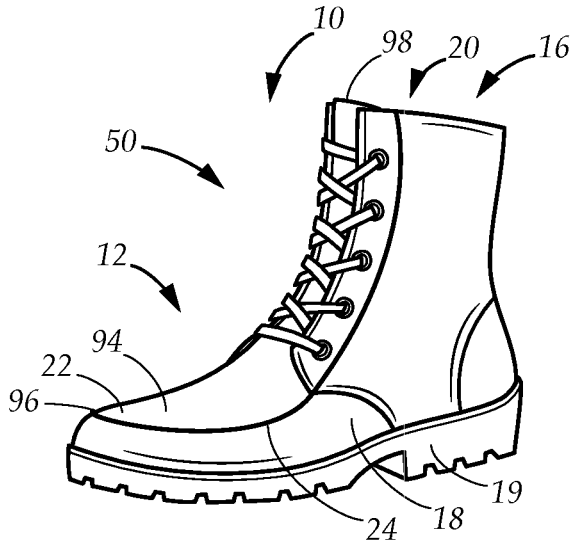
FIG. 11B is a side perspective view of one embodiment of a representative boot in accordance with some embodiments of the present disclosure.
Figure 11C:
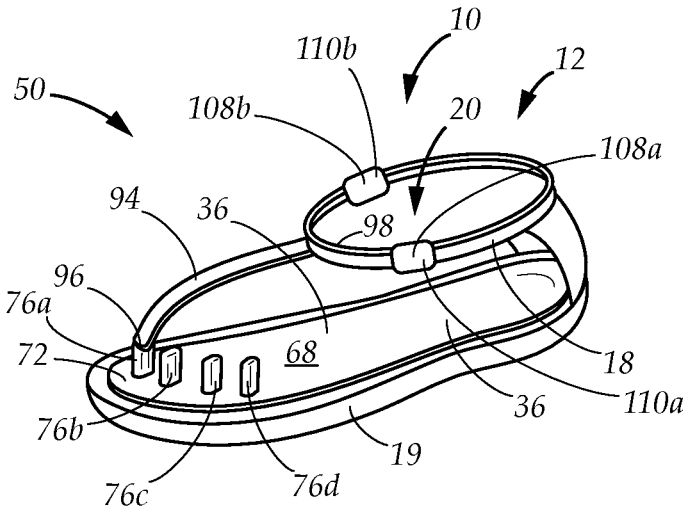
FIG. 11C is a side perspective view of one embodiment of a representative sandal in accordance with some embodiments of the present disclosure.

Referring now to FIGS. 3A, 3B and 6A, in some embodiments, an orthotic positioning system 50 includes one or more insoles 36 configured to position the foot and toes of a user within a shoe 12 to relieve and/or treat common foot and toe deformities, such as hallux valgus, hammertoe, and/or overlapping toes. As shown in FIGS. 11A, 11B, and 11C, while still referring to FIGS. 3A, 3B and 6A, the shoe 12 may include an athletic shoe, a boot, a sandal, a dress shoe, and/or any other suitable shoe 12, for example.

In some embodiments, the shoe 12 includes an interior 16, an exterior upper 18, and a foot opening 20. The exterior upper 18 may include canvas, leather, nylon, mesh, rubber, foam, and/or any other suitable material. The exterior upper 18 may include any suitable coating, varnish, texture, and/or protectant. In some embodiments, the exterior upper 18 includes a perimeter edge 24 defining an elongate opening 30 extending between the toe box 22 and the foot opening 20.

In some embodiments, the perimeter edge 24 includes opposing lateral edges 26*a*, 26*b* disposed substantially parallel to the longitudinal axis 14 and terminating adjacent to the toe box 22. In some embodiments, the perimeter edge 24 extends substantially perpendicularly from each of the lateral edges 26*a*, 26*b* to form a connecting edge 27. The lateral edges 26*a*, 26*b* and/or the connecting edge 27 may be substantially straight, curved, scalloped, angled, and/or a combination thereof. The opposing lateral edges 26*a*, 26*b* may be separated by a space or distance 28 equal to a width of the elongate opening 30.

In some embodiments, the shoe 12 includes a wide toe box 22. In some embodiments, the toe box 22 includes a width 74 between about 5 cm and about 13 cm. In some embodiments, the width 74 of the toe box 22 substantially corresponds to a toe area 72 of the insole 36. Thus, when the insole 36 is disposed within the interior 16 of the shoe 12, the toe area 72 and/or the resilient toe separator elements 76*a*-76*d* may be positioned within the toe box 22 and visible through the elongate opening 30.

The shoe insole 36 may include a resilient cushion material including, for example, latex foam rubber, silicone, and/or a polymer material such as polyurethane ("PU") or ethylene-vinyl acetate copolymer ("EVA"). In some embodiments, the insole 36 may include any combination of ridges, recesses, grooves, bumps, and/or any other suitable textures or features to improve user comfort, fit, breathability, aesthetics, and/or the like.

In some embodiments, the orthotic positioning system 50 includes more than one insole 36 configured to be disposed successively, one at a time, within the interior 16 of a shoe 12 as the user becomes accustomed to the resilient toe separator elements 76*a*-76*d* and a wider foot spread. In some embodiments, each insole 36 may include progressively wider resilient toe separator elements 76*a*-76*d* configured to spread adjacent toes progressively further apart. In other embodiments, the orthotic positioning system 50 includes a single insole 36 having more than one set 75*a*, 75*b* of resilient toe separator elements 76*a*-76*d*. Each set 75*a*, 75*b* may include progressively wider resilient toe separator elements 76*a*-76*d*, thereby creating progressively greater distances 80 between corresponding adjacent toes.

Figure 2:
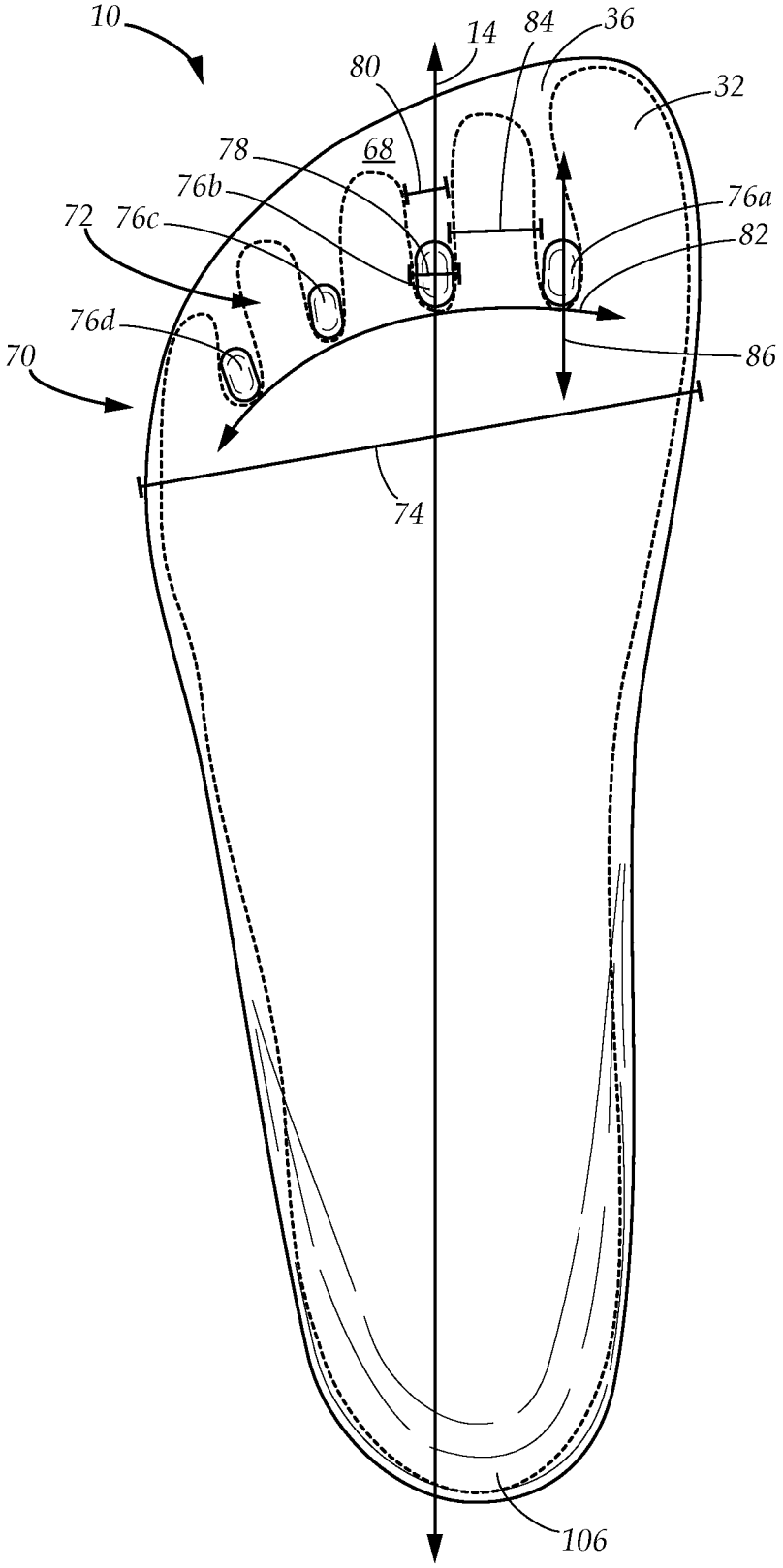
FIG. 2 is a plan view of the insole of FIG. 1, illustrating a representative foot positioned thereon in accordance with some embodiments of the present disclosure.

In one embodiment, the orthotic positioning system 50 includes a first stage insole 38 and a second stage insole 54. Referring now to FIG. 2, while still referring FIGS. 3A, 3B and 6A, each of the insoles 38, 54 may include a set 75*a*, 75*b* of multiple resilient toe separator elements 46*a*-46*d*, 62*a*-62*d* configured to permit a user's forefoot to spread out such that the metatarsals and phalanges 32 separate and maintain a natural position within the shoe 12.

The first stage insole 38 may include a first top surface 40, a first bottom surface 42, a first toe area 44, and first resilient toe separator elements 46*a*-46*d* projecting upwardly from the first top surface 40 along a first arc 52. When the first stage insole 38 is disposed within the interior 16 of the shoe 12, the first resilient toe separator elements 46*a*-46*d* may be positioned within the toe box 22. Each of the first resilient toe separator elements 46*a*-46*d* may include a first width 53 configured to separate adjacent ones of the user's toes 32 by a first predetermined distance 80*a*.

The second stage insole 54 may be configured to selectively replace the first stage insole 38 after the user has become accustomed to the first predetermined distance 80*a* imposed by the first stage insole 38. The second stage insole 54 may include multiple second resilient toe separator elements 62*a*-62*d* having an increased predetermined space 64 disposed therebetween. In this manner, the user may achieve an increased distance between adjacent toes 32 while limiting associated user discomfort.

Like the first stage insole 38, the second stage insole 54 may include a second top surface 56, a second bottom surface 58, a second toe area 60 configured to receive the user's toes 32, and second resilient toe separator elements 62*a*-62*d* projecting upwardly from the second top surface 56 along a second arc 66. In certain embodiments, the shape of the second resilient toe separator elements 62*a*-62*d* is substantially identical to the shape of the first resilient toe separator elements 46*a*-46*d*. Similarly, the shape of the second arc 66 may be substantially identical to the shape of the first arc 52. When the second stage insole 54 is disposed within the interior 16 of the shoe 12, the second toe area 60 and second resilient toe separator elements 62*a*-62*d* may be positioned within the toe box 22 of the shoe 12.

In some embodiments, each of the second resilient toe separator elements 62*a*-62*d* includes a second width 67 that is greater than the first width 53. The second width 67 may be greater than the first width 53 and may be configured to separate adjacent toes 32 of the user by a second predetermined distance 80*b* which is greater than the first predetermined distance 80*a*.

In other embodiments, the first resilient toe separator elements 46*a*-46*d* may be replaceable by the second resilient toe separator elements 62*a*-62*d* independently of the first stage insole 38 and the second stage insole 54. Thus, in some embodiments, a single insole 36 may configured to successively receive and support each of the first resilient toe separator elements 46*a*-46*d* and the second resilient toe separator elements 62*a*-62*d*.

Figure 4A:
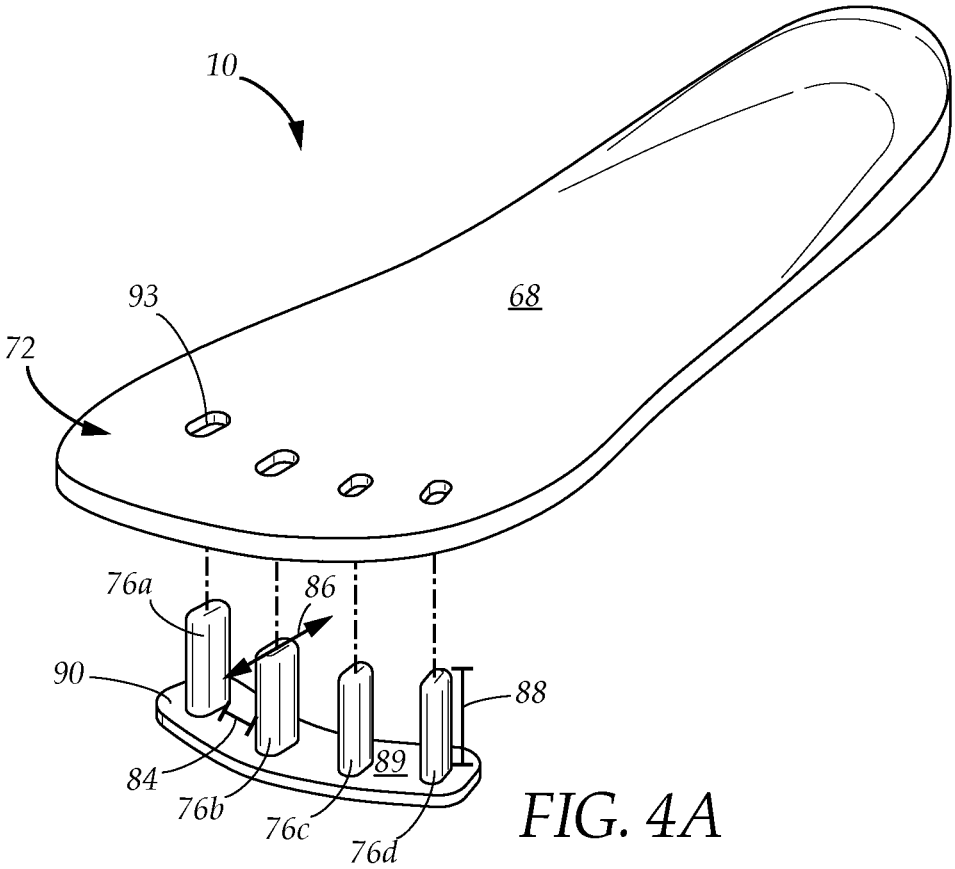
FIG. 4A is a top perspective view of an embodiment of a connector strip having multiple resilient toe separator elements being coupled to an insole in accordance with certain embodiments of the present disclosure.
Figure 4B:
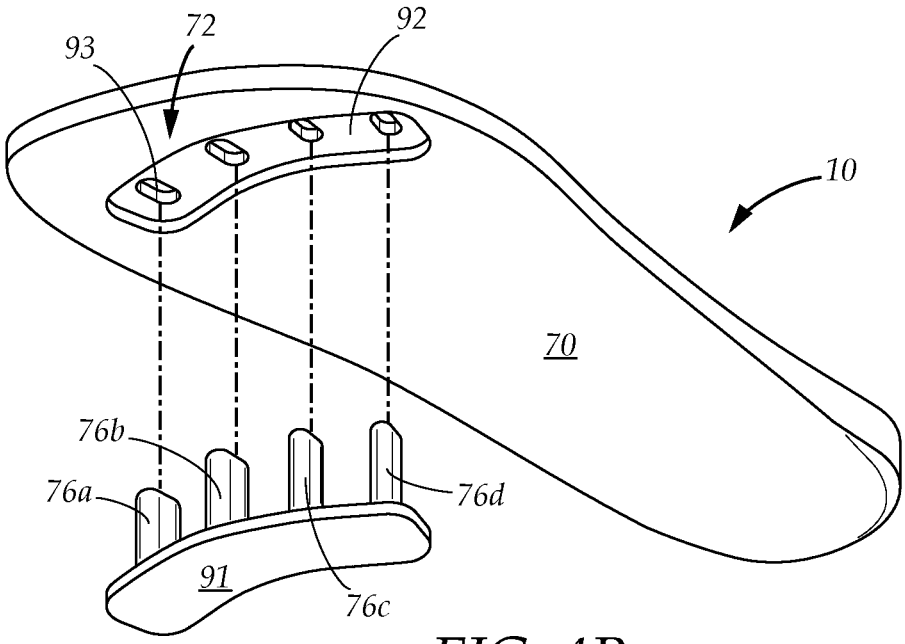
FIG. 4B is a bottom perspective view of the connector strip and insole of FIG. 4A.
Figure 5:
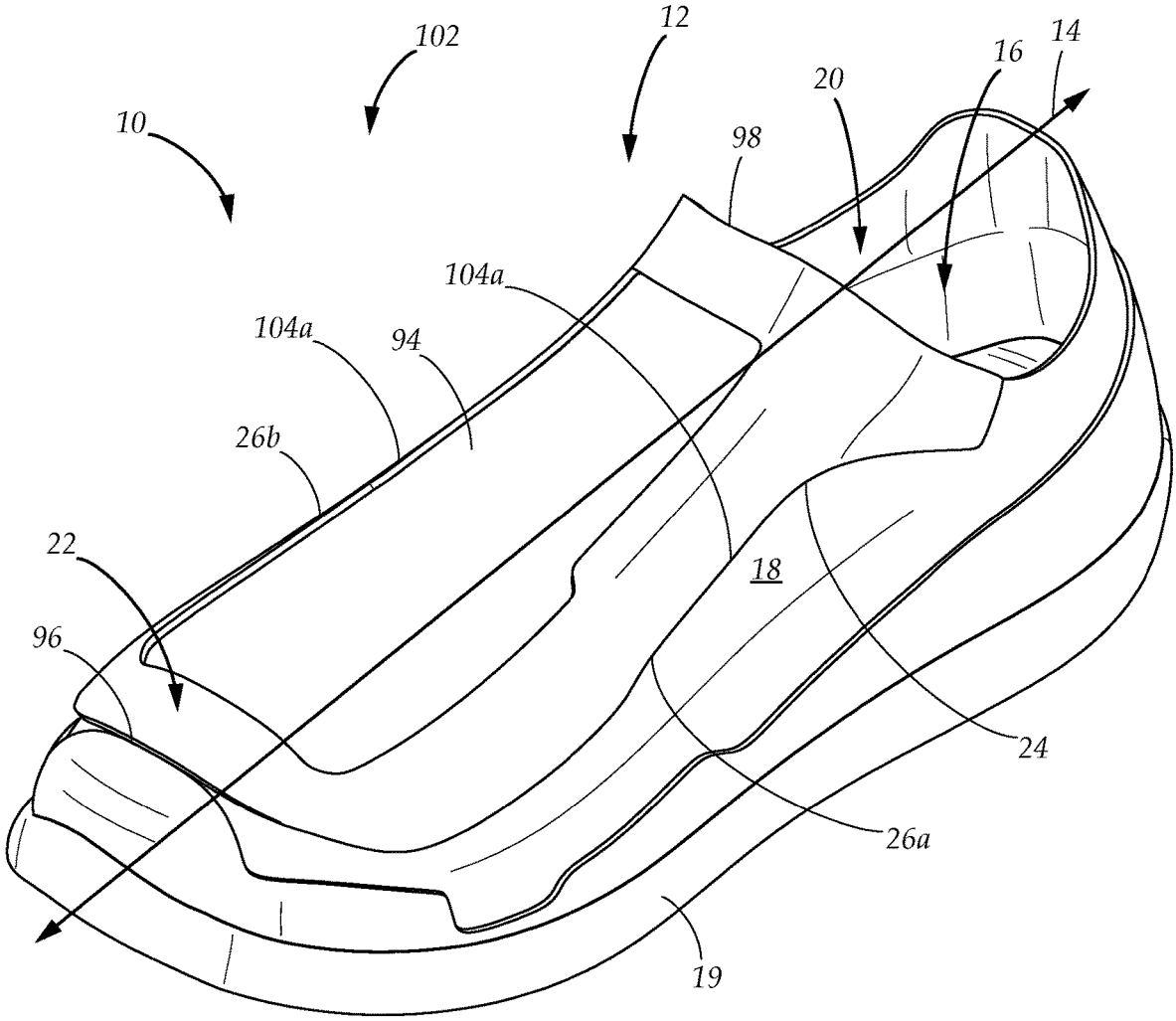
FIG. 5 is a three-quarters perspective view of one embodiment of the orthotic positioning apparatus showing a representative shoe having the cover extended over the elongate opening in accordance with certain embodiments of the present invention.

Referring now to FIGS. 4A and 4B, while also referring to FIGS. 2 and 5, for example, in some embodiments, the resilient toe separator elements 76*a*-76*d* are coupled to a connector strip 90 such that they protrude upwardly therefrom. The connector strip 90 may include a substantially planar, elongate strip including a top side 89 and a bottom side 91. In some embodiments, the connector strip 90 includes silicone or another suitable material configured to be integrated with or coupled to the resilient toe separator elements 76*a*-76*d*. In certain embodiments, the connector strip 90 is coupled to the insole 36 such that the connector strip 90 extends substantially perpendicularly relative to the longitudinal axis 14 and the resilient toe separator elements 76*a*-76*d* are disposed within the toe box 22 when disposed within the shoe 12.

Referring now to FIGS. 3A and 3B, while still referring to FIGS. 4A and 4B, in some embodiments, a first connector strip 90 may include first resilient toe separator elements 46*a*-46*d* and a second connector strip 90 may include second resilient toe separator elements 62*a*-62*d*. Each connector strip 90 may be selectively removably coupled to the insole 36 depending on a desired distance 80 between adjacent toes 32. In this manner, the user may selectively replace one connector strip 90 and associated resilient toe separator elements 76*a*-76*d* with another connector strip 90 having different resilient toe separator elements 76*a*-76*d*.

In one embodiment, the resilient toe separator elements 76*a*-76*d* are molded, welded, or otherwise coupled to the top side 89 of the connector strip 90. The toe area 72 of the insole 36 may include a recess 92 disposed in its bottom surface 70. The recess 92 may include a size and shape substantially corresponding to the size and shape of the connector strip 90.

In some embodiments, the insole 36 may include multiple apertures 93 extending between the top surface 68 and the bottom surface 70. In one embodiment the apertures 93 are disposed in the recess 92. Each of the apertures 93 may have a size and a shape sufficient to accommodate one of the resilient toe separator elements 76*a*-76*d*. Further, the apertures 93 may be oriented to correspond to a position of the resilient toe separator elements 76*a*-76*d* protruding from the connector strip 90. Thus, in some embodiments, the connector strip 90 is connected to the insole 36 by inserting the resilient toe separator elements 76*a*-76*d* through corresponding apertures 93 and mounting the connector strip 90 within the recess 92. In some embodiments, the connector strip 90 may be further coupled to the recess 92 via an adhesive and/or other suitable fastening mechanism.

In some embodiments, the top surface 89 of the connector strip 90 is disposed adjacent to the bottom surface 70 of the insole 36 within the recess 92 such that the resilient toe separator elements 76*a*-76*d* project upwardly through the corresponding apertures 93 and the top surface 68 of the insole 36. In this manner, the bottom side 91 of the connector strip 90 may be substantially flush with the bottom surface 70 of the insole 36. In certain embodiments, the connector strip 90 is substantially rigid to provide support and stability to the resilient toe separator elements 76*a*-76*d*.

In some embodiments, the dimensions of each aperture 93 may be at least slightly greater than the greatest desired width 78 of a corresponding resilient toe separator element 76*a*-76*d*. In other embodiments, the recess 92 and/or portion of the insole 36 surrounding each aperture 93 may include a substantially flexible or elastic material configured to conform to the dimensions of the corresponding resilient toe separator element 76*a*-76*d*.

Figure 6B:
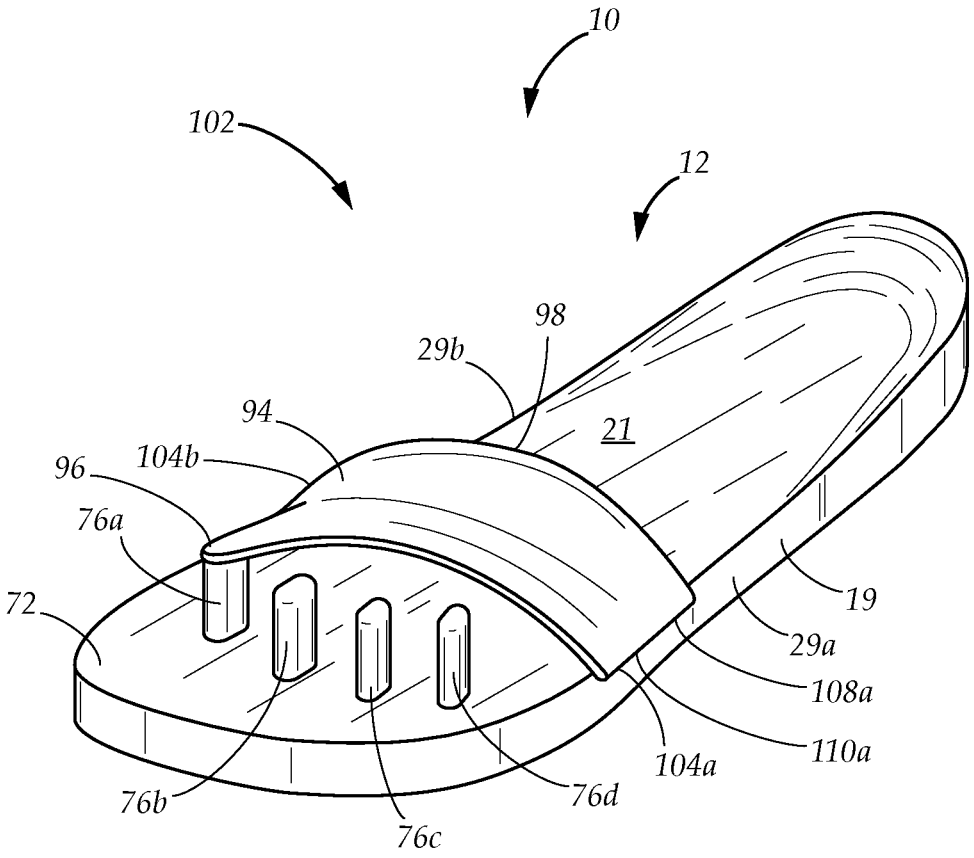
FIG. 6B is a perspective view of one embodiment of a T-strap sandal-type shoe having multiple toe separator elements incorporated into the sole, where the cover extends from one of the toe separator elements to form the T-strap and is configured to open upwardly in accordance with some embodiments of the present disclosure.
Figure 6C:
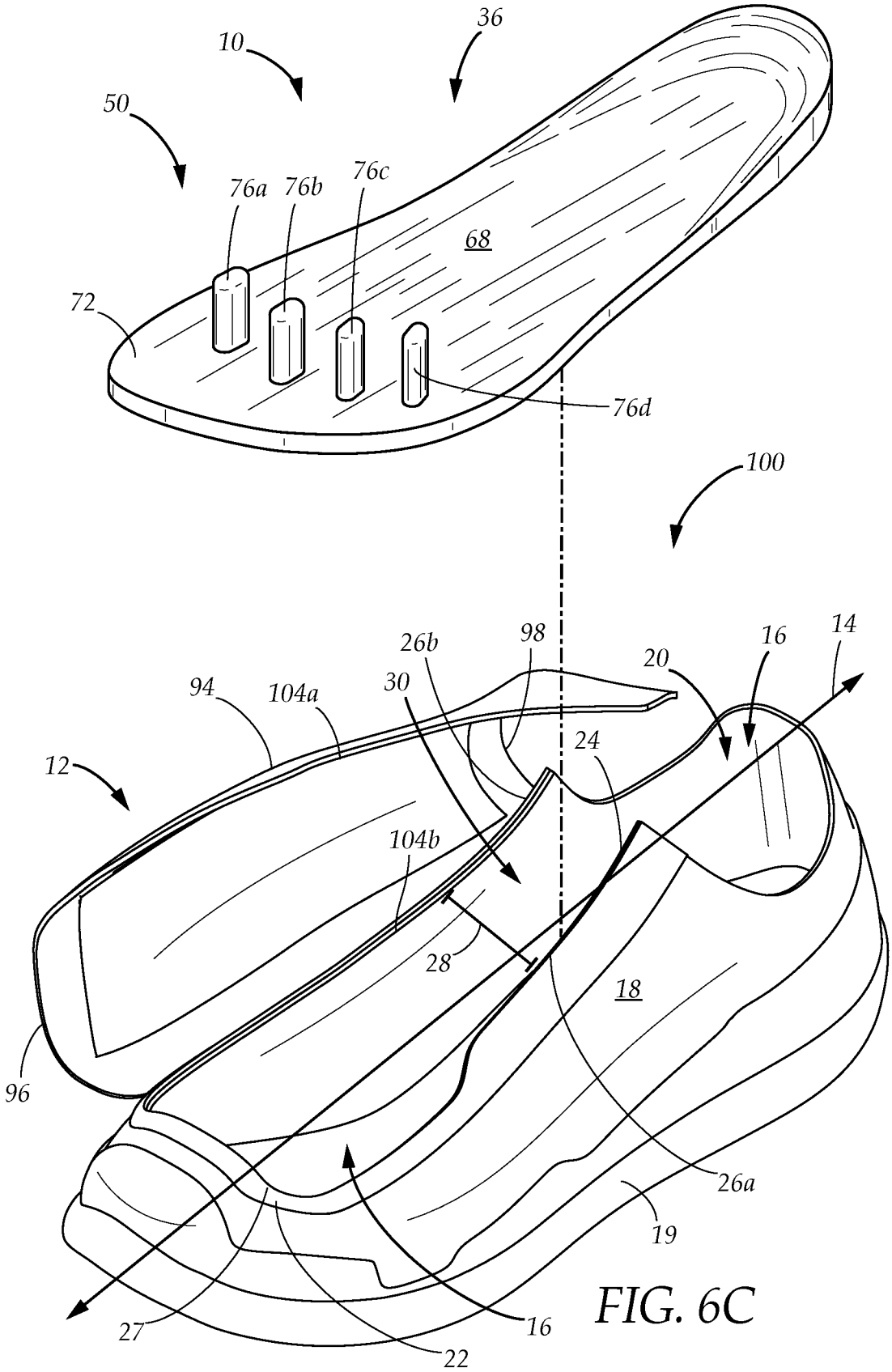
FIG. 6C is a perspective view of an embodiment of an orthotic positioning system including a shoe having a cover attached to a lateral edge of the shoe exterior and configured to pivot laterally to expose the toe separator elements in accordance with some embodiments of the disclosure.

Referring now to FIGS. 5, 6A, and 6C, in some embodiments, the shoe 12 includes a cover 94 having dimensions and a shape configured to substantially shield the elongate opening 30. In some embodiments, the cover 94 includes a substantially rectangular shape having opposing side edges 104*a*, 104*b* extending substantially parallel to the longitudinal axis 14. In certain embodiments, the side edges 104*a*, 104*b* are substantially aligned with the lateral edges 26*a*, 26*b* of the exterior upper 18 such that the side edges 104*a*, 104*b* substantially meet and/or overlap the lateral edges 26*a*, 26*b* when the cover 94 is in a closed configuration 102.

In some embodiments, the cover 94 includes a top edge 96 extending substantially perpendicularly from the opposing side edges 104*a*, 104*b*. The top edge 96 may be disposed adjacent to the toe box 22 and/or the connecting edge 27 of the exterior upper 18. Similarly, a bottom edge 98 may extend substantially perpendicularly from the opposing side edges 104*a*, 104*b* adjacent to the foot opening 20 of the exterior upper 18.

In some embodiments, as shown in FIG. 6A, the top edge 96 of the cover 94 is pivotally, rotatably, and/or removably coupled to the exterior upper 18 of the shoe 12 at the toe box 22 and/or the connecting edge 27. Alternatively, as shown in FIG. 6B, the top edge 96 may be coupled to one or more of the multiple resilient toe separator elements 76*a*-76*d*.

Figure 6D:
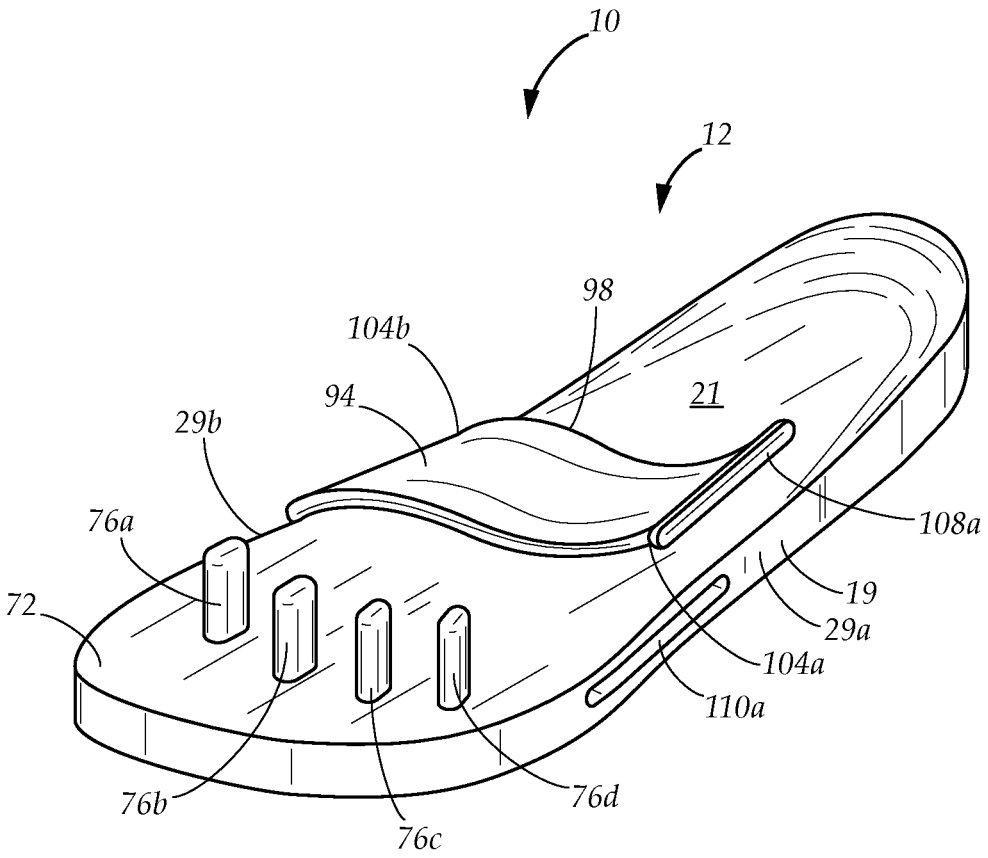
FIG. 6D is a perspective view of one embodiment of a slide sandal-type shoe having multiple toe separator elements incorporated into the sole, where the cover includes a strap directly coupled to a lateral edge of the sole and configured to pivot upwardly from the lateral edge in accordance with certain embodiments of the present disclosure.

In some embodiments, as shown in FIGS. 6B-6D, at least one side edge 104*a*, 104*b* is pivotally, rotatably, and/or removably coupled to a corresponding lateral edge 29*a*, 29*b* of the sole 19. In other embodiments, as shown in FIG. 6C, at least one side edge 104*a*, 104*b* of the cover 94 is pivotally, rotatably, and/or removably coupled to a corresponding lateral edge 26*a*, 26*b* of the exterior upper 18 of the shoe 12. In these and other embodiments, the cover 94 is configured to pivot upwardly and/or laterally relative to the exterior upper 18, insole 36, and/or sole 19 to expose the resilient toe separator elements 76*a*-76*d*. In certain embodiments, at least a portion of the cover 94 may be fully or partially removed from the exterior upper 18, insole 36, and/or sole 19 to further facilitate proper toe placement relative to the resilient toe separator elements 76*a*-76*d*.

In some embodiments, the top edge 96 is fixably, pivotally, and/or removably coupled to the toe box 22 and/or to the connecting edge 27 via stitching, a hinge, a rivet, a grommet, a snap, a button, a zipper, a press fit, and/or any other suitable mechanical connection. Similarly, in some embodiments, the side edge 104*a*, 104*b* is fixably, pivotally, and/or removably coupled to the corresponding lateral edge 26*a*, 26*b* of the exterior upper 18 or lateral edge 29*a*, 29*b* of the sole 19 via stitching, a hinge, a rivet, a grommet, a snap, a button, a zipper, a press fit, and/or any other suitable mechanical connection.

In some embodiments, the cover 94 is configured to selectively pivot upwardly or laterally between a closed configuration 102 and an open configuration 100. The open configuration 100 may expose the elongate opening 30, thereby revealing the resilient toe separator elements 76*a*-76*d* within the toe box 22. This feature thus facilitates proper placement of the foot and positioning of the toes with respect to the resilient toe separator elements 76*a*-76*d* inside the shoe 12.

Figure 7:
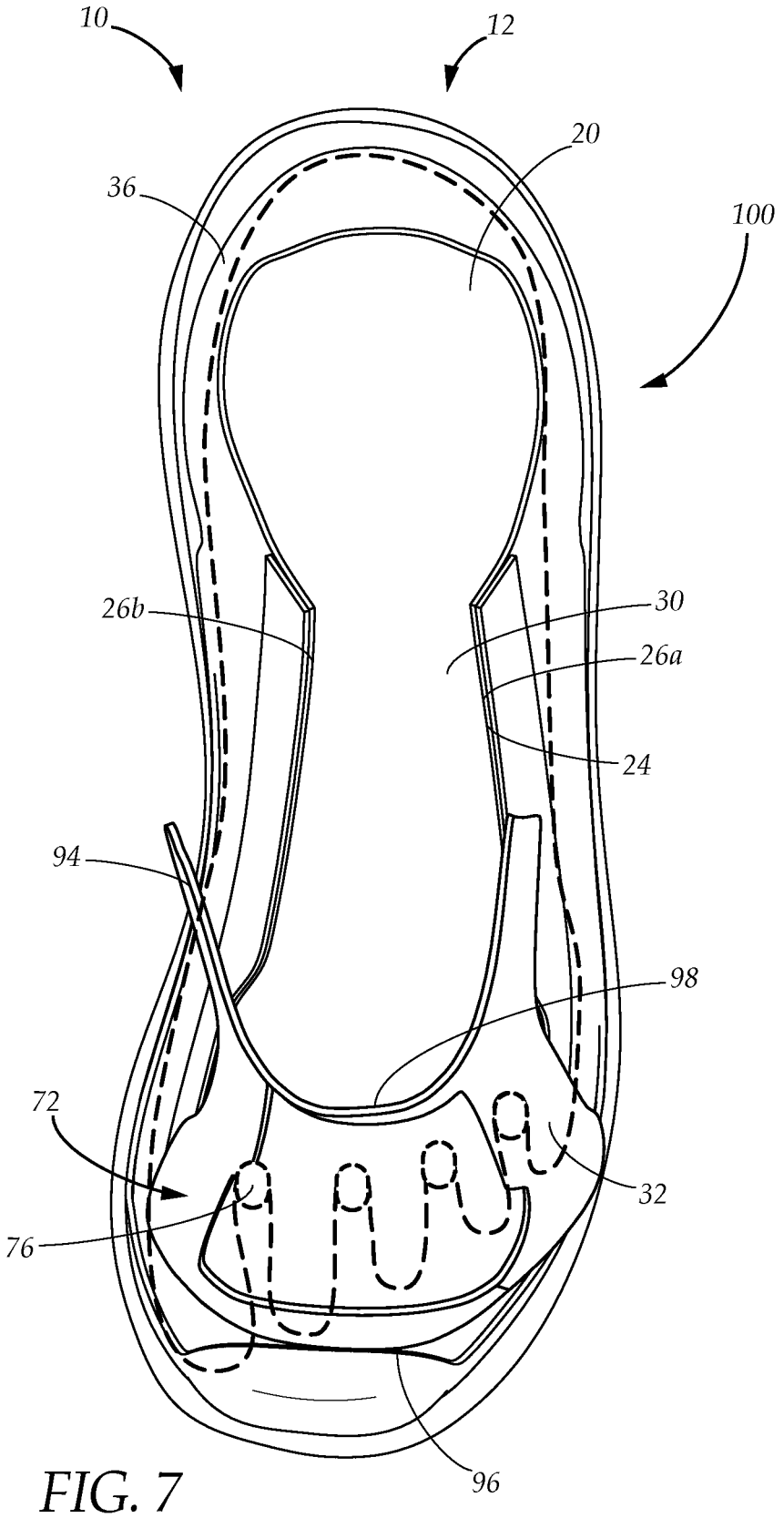
FIG. 7 is a plan view of an embodiment of an insole disposed within a representative shoe, illustrating positioning of a representative foot in accordance with certain embodiments of the present disclosure.

Referring now to FIGS. 6B, 6D, and 7, while referring also to FIGS. 3A and 3B, in some embodiments, the multiple resilient toe separator elements 76*a*-76*d* are integrated with or coupled directly to the sole 19 of the shoe 12 rather than to the insole 36. For example, in some embodiments, the shoe 12 or sandal may include a sole 19 without a separate or independent insole 36. Thus, the multiple resilient toe separator elements 76*a*-76*d* may be directly integrated with or coupled to the sole 19 such that they project upwardly from its top surface 21.

In some embodiments, one or more of the resilient toe separator elements 76*a*-76*d* is removably coupled to the sole 19 or insole 36 to permit the user to selectively replace and/or reposition one or more of the resilient toe separator elements 76*a*-76*d*. In these and other embodiments, the user may replace one or an entire set 75*a*, 75*b* of resilient toe separator elements 76*a*-76*d* with another one or entire set 75*a*, 75*b* of resilient toe separator elements 76*a*-76*d* having identical or varying dimensions, placement, and/or orientation.

Figure 8A:
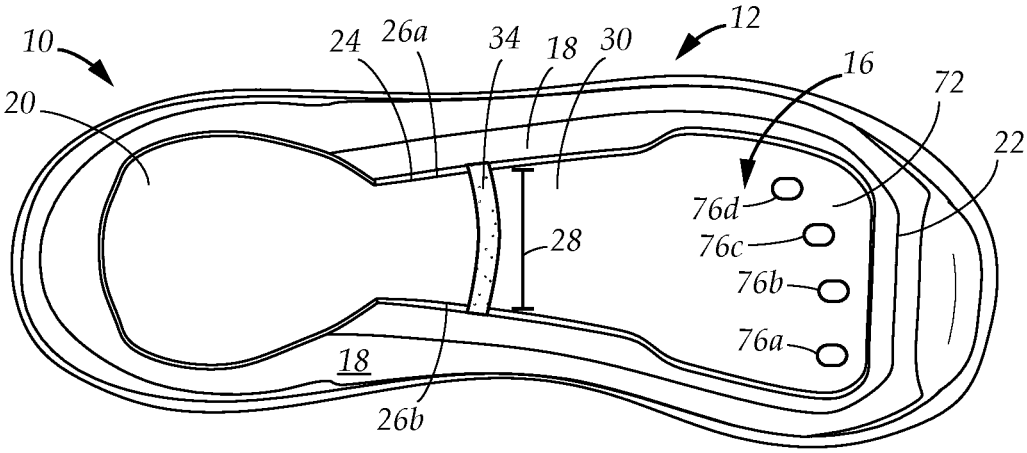
FIG. 8A is a top perspective view of a representative shoe including one embodiment of a stabilization element in accordance with some embodiments of the present disclosure.
Figure 8B:
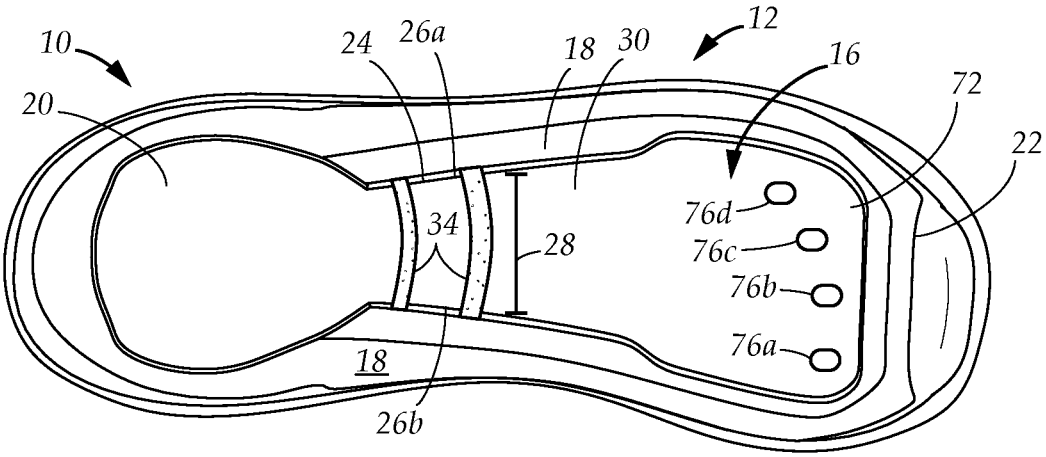
FIG. 8B is a top perspective view of another representative shoe including another embodiment of a stabilization element accordance with some embodiments of the present disclosure.
Figure 8C:
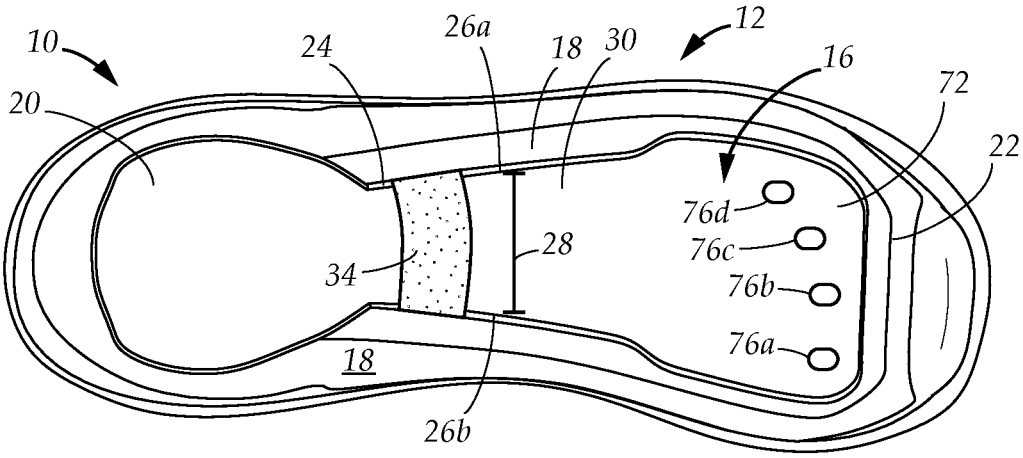
FIG. 8C is a top perspective view of another representative shoe including a third embodiment of a stabilization element in accordance with certain embodiments of the present disclosure.

Referring now to FIGS. 8A-8C, in some embodiments, the orthotic positioning apparatus 10 may omit the top cover 94 shown in FIG. 7. In these and other embodiments, the orthotic positioning apparatus 10 may include one or more stabilization elements 34 extending substantially perpendicularly between the lateral edges 26*a*, 26*b* of the exterior upper 18. The stabilization element 34 may increase stability and/or reinforce the structural integrity of the shoe 12. In some embodiments, the stabilization element 34 may include one or more elongate strips of a rigid, resilient, or flexible material configured to selectively adjust or tighten the foot opening 20 around the foot of a user.

In one embodiment, the stabilization element 34 includes one or more elongate strips of a resilient fabric or elastic. In some embodiments, the orthotic positioning apparatus 10 includes a mechanical tightening device mechanism such as a buckle, a snap, a button, a tie, or any other device or mechanism to engage the stabilization element 34 and selectively fix its position relative to the shoe 12. For example, in some embodiments, the stabilization element 34 may be selectively shortened to thereby reduce a circumference of the foot opening 20 and/or to reduce a distance 28 between the lateral edges 26*a*, 26*b*.

In some embodiments, the stabilization element 34 obstructs at least a portion of the elongate opening 30 to stabilize the shoe 12 with respect to a foot of the user. In certain embodiments, the stabilization element 34 may be adjustable and/or removable to minimize interference with visibility of the resilient toe separator elements 76*a*-76*d* disposed within the shoe 12.

Figure 9A:
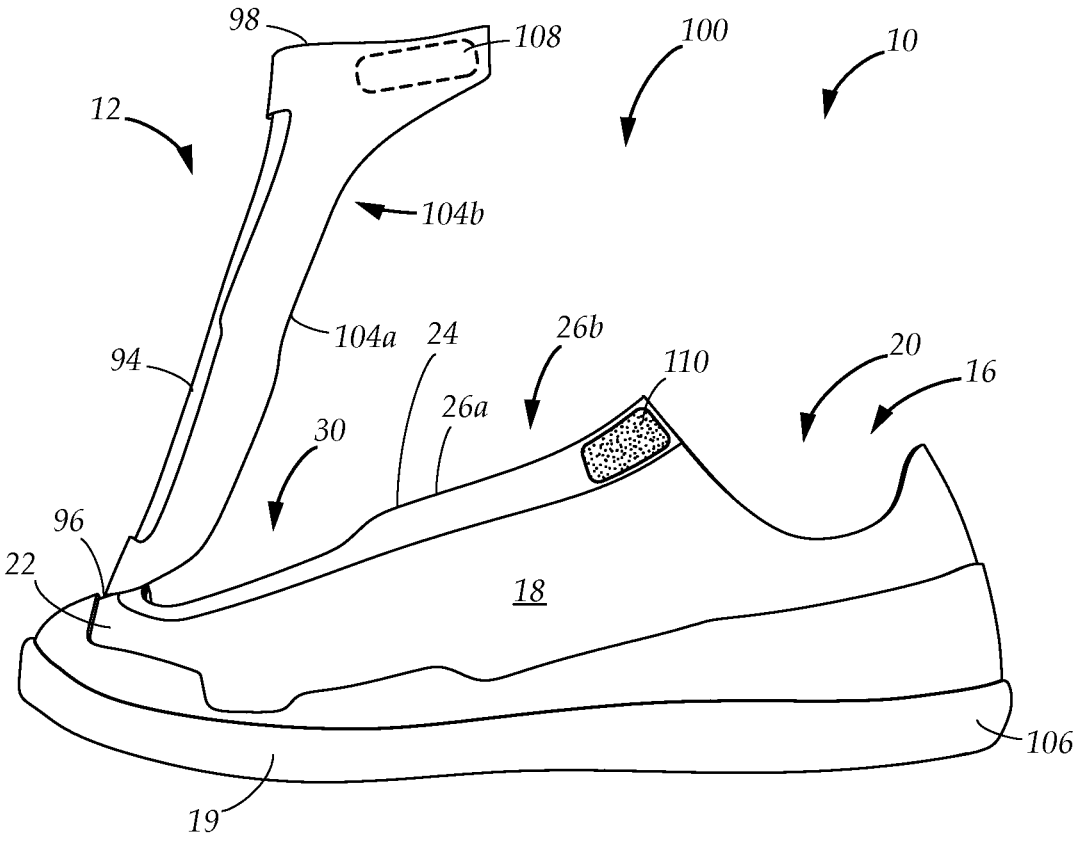
FIG. 9A is a side perspective view of one embodiment of a shoe having the cover in an open position in accordance with some embodiments of the present disclosure.
Figure 9B:
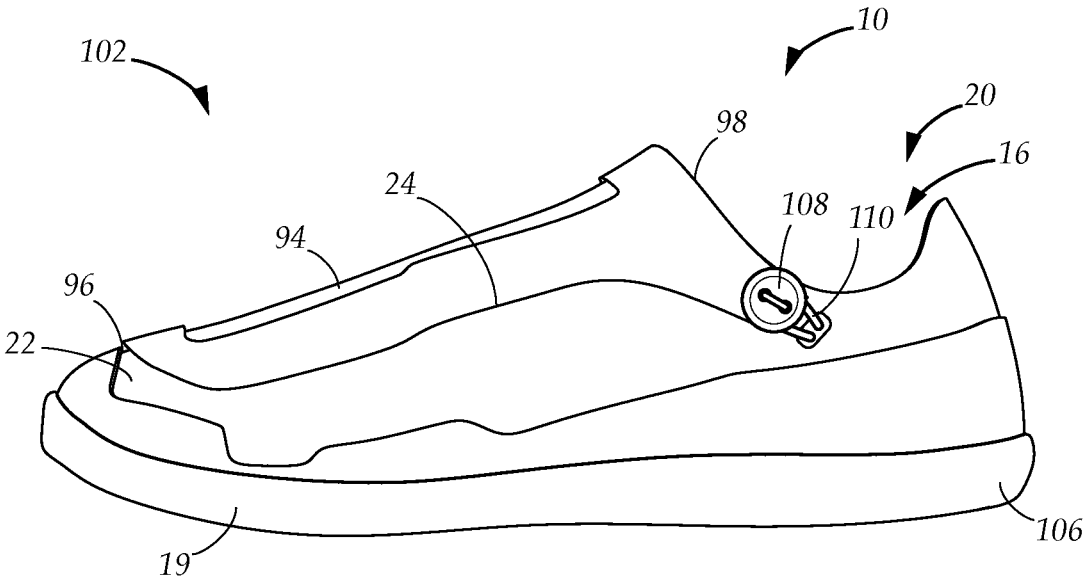
FIG. 9B is a side perspective view of the shoe of FIG. 9A with the cover in a closed position in accordance with some embodiments of the present disclosure.
Figure 10:
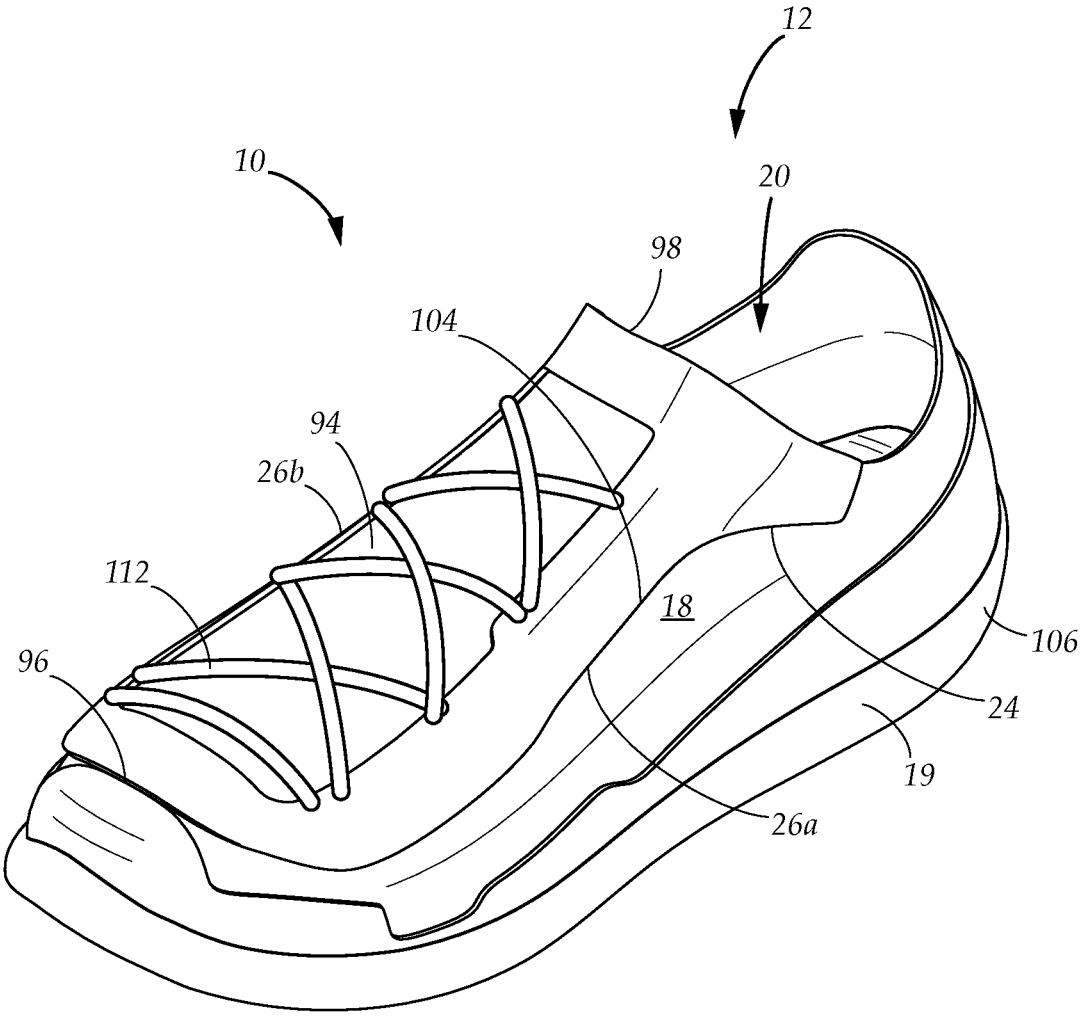
FIG. 10 is a three-quarters perspective view of one embodiment of a shoe having ornamental laces in a closed position in accordance with some embodiments of the present disclosure.

Referring now to FIGS. 9A, 9B, and 10, while also referring to FIGS. 1 and 2, in embodiments including an insole 36 configured to provide zero-drop, the sole 19 of the shoe 12 may also provide a zero-drop heel 106, or no height difference between the interior 16 toe area 72 and the interior 16 heel area 106. Importantly, this feature prevents negation or reduction of a zero-drop effect by either the insole 36 or the sole 19.

In some embodiments, the cover 94 includes one or more attachment portions 108 disposed adjacent to the bottom edge 98 and/or one or both of the side edges 104*a*, 104*b*. In these and other embodiments, at least a portion of the attachment portion 108 may extend along at least a portion of one or both side edges 104*a*, 104*b*. The exterior upper 18 may include an engagement element 110 configured to removably engage the attachment portion 108 to promote stability, security, and/or a customized fit of the shoe 12 with respect to the user. In some embodiments, the engagement element 110 may be positioned along the exterior upper 18 to substantially correspond to the attachment portion 108 when the cover 94 is in a closed configuration 102. In certain embodiments, the engagement element 110 may meet or overlie the attachment portion 108 when the cover 94 is in the closed configuration 102.

In one embodiment, for example, the attachment portion 108 and the engagement element 110 include corresponding portions of a hook and loop fabric. In other embodiments, the attachment portion 108 may include one or more loops, apertures, buttons, snaps, zippers, buckles, ties, and/or any other suitable attachment feature. Similarly, the engagement element 110 may include one or more loops, apertures, buttons, snaps, zippers, buckles, ties, and/or any other suitable feature configured to removably engage the attachment portion 108.

Referring now to FIGS. 11A, 11B, and 11C, various types of shoes 12 may be used in connection with embodiments of the orthotic positioning apparatus 10 and orthotic positioning system 50 disclosed herein. For example, the shoe 12 may include a sneaker, an oxford, a loafer, a platform shoe, a slipper, an espadrille, a snow boot, a work boot, a hiking boot, a mule, a sandal and/or any other suitable shoe 12. In some embodiments, the shoe 12 includes a substantially flat sole 19 as well as a substantially flat insole 36 to provide zero-drop.

In certain embodiments, the shoe 12 includes a perimeter edge 24 extending from the toe box 22 to the foot opening 20. The perimeter edge 24 may define an elongate opening 30 (shown in FIG. 7) configured to selectively expose the interior 16 of the shoe 12, including the toe area 72 and the multiple resilient toe separator elements 76*a*-76*d*.

In one embodiment, as shown in FIG. 11C, while also referring to FIGS. 6B, 6D, and 11A-11B, the shoe 12 includes a sandal that does not include a toe box 22. The cover 94 may include a T-strap having a top edge 96 coupled to and/or extending from the toe area 72 of the insole 36 or sole 19 such that the bottom edge 98 of the cover 94 extends toward the foot opening 20. In some embodiments, the top edge 96 of the cover 94 is coupled to one or more of the multiple resilient toe separator elements 76*a*-76*d*. In other embodiments, the top edge 96 of the cover 94 may be coupled to the top surface 68 of the insole 36 or sole 19 such that the top edge 96 substantially corresponds to placement of one or more of the multiple resilient toe separator elements 76*a*-76*d*.

In one embodiment, the bottom edge 98 of the cover 94 includes a pair of attachment portions 108*a*, 108*b* configured to engage a corresponding pair of engagement elements 110*a*, 110*b* of the exterior upper 18. For example, the attachment portions 108*a*, 108*b* and the engagement elements 110*a*, 110*b* may include corresponding portions of a clasp configured to engage one another to secure the foot opening 20 relative to the user. In another embodiment, as shown in FIG. 6D, at least one attachment portion 108*a* is configured to engage a corresponding engagement element 110*a* integrated with or coupled to a lateral edge 29*a* of the sole 19. Of course, the attachment portion 108*a* and the engagement element 110*a* are not limited to those depicted herein and may include any suitable number, size, shape and/or type.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

In conclusion, the disclosure is illustrated by example in the drawing figures, and throughout the written description. It should be understood that numerous variations are possible, while adhering to the inventive concept. Such variations are contemplated as being a part of the present disclosure.

What is claimed is:

1. An orthotic positioning apparatus, comprising:

a shoe extending along a longitudinal axis, the shoe comprising an interior, an exterior upper, a foot opening, and a toe box, wherein the exterior upper comprises a perimeter edge defining an elongate opening extending between the toe box and the foot opening;

an insole removably disposed within the interior, wherein the insole comprises a top surface, a bottom surface, and a toe area configured to receive a user's toes;

a plurality of resilient toe separator elements disposed at the toe area, the plurality of resilient toe separator elements projecting upwardly from the top surface along an arc and positioned within the toe box, each of the plurality of resilient toe separator elements including a proximal end adjacent the toe area, a distal end opposite the proximal end, and a width configured to separate adjacent toes of the user's foot by a predetermined distance; a planar connector strip interconnecting the proximal ends of the plurality of resilient toe separator elements, the connector strip including an upper surface, each of the plurality of resilient toe separator elements projecting upwardly from the upper surface, wherein the bottom surface of the insole comprises a recess configured to receive the connector strip; and a cover configured to cover the elongate opening, wherein the cover comprises a side edge, a bottom edge substantially adjacent to the foot opening, and a top edge pivotally coupled to the toe box, wherein the cover is configured to selectively pivot from at least one of the top edge and the side edge to an open configuration such that the elongate opening is configured to expose the plurality of resilient toe separator elements in the open configuration when the insole is disposed in the shoe.

2. The orthotic positioning apparatus of claim 1, wherein the perimeter edge comprises a pair of lateral edges disposed parallel to the longitudinal axis and separated by a distance corresponding to a width of the toe area.

3. The orthotic positioning apparatus of claim 2, further comprising at least one stabilization element extending perpendicularly between the pair of lateral edges.

4. The orthotic positioning apparatus of claim 3, wherein the stabilization element obstructs at least a portion of the elongate opening.

5. The orthotic positioning apparatus of claim 4, wherein the stabilization element is at least one of adjustable and removable.

6. The orthotic positioning apparatus of claim 2, wherein the side edge of the cover is removably coupled to the lateral edges of the exterior upper via a zipper.

7. The orthotic positioning apparatus of claim 1, wherein at least one of the shoe and the insole comprises a heel configured to provide zero-drop.

8. The orthotic positioning apparatus of claim 1, wherein the cover comprises an attachment portion disposed adjacent to the bottom edge.

9. The orthotic positioning apparatus of claim 8, wherein the exterior upper comprises an engagement element configured to selectively engage the attachment portion.

10. The orthotic positioning apparatus of claim 1, wherein the insole comprises a predetermined space between adjacent resilient toe separator elements, wherein the predetermined space is configured to accommodate one of the user's toes.

11. The orthotic positioning apparatus of claim 10, wherein the predetermined space is between 1.0 cm and 1.8 cm.

12. The orthotic positioning apparatus of claim 10, wherein the width of each of the plurality of resilient toe separator elements is less than the predetermined space.

13. The orthotic positioning apparatus of claim 1, wherein each of the plurality of resilient toe separator elements comprises a dome shape having an elongate top surface extending along an axis parallel to the longitudinal axis.

14. The orthotic positioning apparatus of claim 13, wherein each of the plurality of resilient toe separator elements comprises a height greater than or equal to the predetermined space.

15. The orthotic positioning apparatus of claim 14, wherein the height ranges between 1.0 cm and 2.2 cm.

16. The orthotic positioning apparatus of claim 1, wherein each of the plurality of resilient toe separator elements extends through the insole between the bottom surface and the top surface.

17. The orthotic positioning apparatus of claim 1, wherein each of the plurality of resilient toe separator elements includes a uniform cross-sectional area extending from the proximal end to the distal end.

18. The orthotic positioning apparatus of claim 1, wherein the connector strip is rigid such that the connector strip provides support and stability to the plurality of resilient toe separator elements.

* * * * *